US005104601A

United States Patent [19]

Siegel

[11] Patent Number: 5,104,601

[45] Date of Patent: Apr. 14, 1992

[54] PROCESS FOR PRODUCING A POLYHEXAMETHYLENE ADIPAMIDE, CAPROLACTAM AND POLYPROPYLENE FIBER

[75] Inventor: Barbara L. Siegel, Seaford, Del.

[73] Assignee: E. I. Du Pont de Nemours and Company, Wilmington, Del.

[21] Appl. No.: 904,681

[22] Filed: Sep. 8, 1986

Related U.S. Application Data

[63] Continuation-in-part of Ser. No. 813,465, Jan. 3, 1986, abandoned.

[51] Int. Cl.[5] ..... D01F 6/70

[52] U.S. Cl. ..... 264/169; 264/171; 264/211

[58] Field of Search ..... 264/171, 210.6, 210.8, 264/211, 169, 300; 525/184

[56] References Cited

U.S. PATENT DOCUMENTS

| | | | |
|---|---|---|---|
| 3,093,255 | 6/1963 | Mesrobion et al. | 525/184 |
| 3,373,222 | 3/1968 | Armstrong | 525/179 |
| 3,373,223 | 3/1968 | Armstrong | 525/179 |
| 3,707,522 | 12/1972 | Simons | 524/606 |
| 3,936,394 | 2/1976 | Kusunose et al. | 502/106 |
| 3,995,084 | 11/1976 | Beyer et al. | 264/216 |
| 4,424,257 | 1/1981 | Bach | 264/171 |
| 4,444,817 | 4/1984 | Cubramanian | 264/171 |
| 4,559,196 | 12/1985 | Kobsa et al. | 264/171 |

FOREIGN PATENT DOCUMENTS

| | | | |
|---|---|---|---|
| 5415026 | 2/1979 | Japan | 264/171 |
| 1081347 | 8/1967 | United Kingdom . | |
| 1291838 | 10/1972 | United Kingdom | 525/184 |

*Primary Examiner*—Hubert C. Lorin

[57] ABSTRACT

A process for producing a nylon 6,6 and polypropylene fiber wherein deposits of polypropylene on the yarn guide surface are substantially eliminated by adding nylon 6.

5 Claims, No Drawings

PROCESS FOR PRODUCING A POLYHEXAMETHYLENE ADIPAMIDE, CAPROLACTAM AND POLYPROPYLENE FIBER

CROSS-REFERENCE TO RELATED APPLICATION

This application is a continuation-in-part of application Ser. No. 813,465, filed Jan. 3, 1986, now abandoned.

DESCRIPTION

1. Technical Field

This invention relates to the process of adding caprolactam to a polyhexamethylene adipamide and polypropylene mixture to eliminate yarn guide deposits formed during the spinning of polyhexamethylene adipamide and polypropylene fiber and the resultant fiber.

2. Background

Various methods have been employed in the past to achieve delustered melt-spun nylon filaments for textile fiber end users. These methods include modifying the filament cross-section as well as adding compounds such as titanium dioxide and polypropylene to the nylon. The segmentation of polypropylene within a nylon matrix imparts a dramatic delustered appearance to spun and drawn nylon filaments. It has been observed, however, that the cospinning of polypropylene with nylon 6,6 results in unacceptable polypropylene deposits forming on yarn guide surfaces. These deposits negatively affect fiber manufacturing by increasing draw point and spinning breaks, resulting in poor fiber spinning as well as decreased productivity. In attempting to improve the cospinning of polypropylene and nylon 6,6, a method was discovered to eliminate the deposits.

SUMMARY OF THE INVENTION

A process for eliminating yarn guide deposits by producing a nylon 6,6 and polypropylene fiber comprising the steps of: a) mixing 85–97.9% by weight nylon 6,6, 0.1–5% by weight polypropylene and 2–10% by weight nylon 6; b) melt spinning the mixture to form a fiber; and c) drawing the fiber has now been discovered. The yarn guide guides the fiber and is generally used to converge the fiber during melt spinning.

It is to be understood that in the mixing step a) above, nylon 6,6 refers to polyhexamethylene adipamide or its monomeric salt mixture of hexamethylene diamine and adipic acid. Likewise, it is to be understood that nylon 6 refers to polycaproamide or its monomer caprolactam.

In practicing this invention, as the percent of polypropylene is increased in the polymer blend, it is expected that the percent of nylon 6 should also be increased.

A preferred embodiment provides for eliminating yarn guide deposits which accumulate while cospinning polypropylene with nylon 6,6 by polymerizing a small amount of caprolactam monomer with hexamethylene diamine and adipic acid to form a random nylon 6,6/nylon 6 copolymer followed by melt injection of polypropylene into the copolymer melt prior to filament extrusion. The preferred range of components are: 94–97% by weight nylon 6,6, 2–4% by weight nylon 6 and 1–2% by weight polypropylene. In a further preferred embodiment, the fiber further comprises 0.01–0.5% by weight titanium dioxide.

There are alternate methods of adding the caprolactam during the cospinning of polypropylene with nylon. For example, the caprolactam could first be polymerized to nylon 6 and then melted and co-injected with the polypropylene into the nylon 6,6 homopolymer. Caprolactam could also first be polymerized to form nylon 6 and then melt injected into the nylon 6,6 flow upstream from the polypropylene injection port.

The Examples clearly show the advantage of caprolactam in eliminating yarn guide deposits when cospinning polypropylene with nylon 6,6.

TEST METHODS

Molecular weight of the polypropylene is reported as Number Average Molecular Weight and is measured by gel permeation chromatography using NBS-1475 linear polyethylene as the reference standard and orthodichlorobenzene as the solvent.

Melting point in degrees Centigrade was measured by Differential Scanning Calorimetry (DSC).

Softening point is reported in degrees Centigrade as determined by Differential Scanning Calorimetry.

Viscosity of the polypropylene is reported as the viscosity in centipoise (CP) as measured with a Brookfield Thermosel following ASTM-D-3236 at 190° C. and using Spindle No. 34 at 12 rpm.

Identification of polypropylene was by proton NMR and differential solubility analysis using both tetrachloroethylene and formic acid as solvents.

EXAMPLES

Example 1

A random copolymer of nylon 6,6/nylon 6 (96:4 weight ratio) was prepared by polymerizing hexamethylene diamine and adipic acid in the presence of 4% by weight caprolactam to 62 relative viscosity. Titanium dioxide was added at a level of 0.3% by weight to the copolymer. The nylon 6,6/nylon 6 copolymer containing 0.3% titanium dioxide was melted in a screw extruder, then fed through a transfer line to a meter pump, filter pack and spinneret in a conventional manner. During passage of the nylon copolymer through the transfer line, a pelletized polypropylene (molecular weight 6600, melt point of 156° C., viscosity of 320 CP and softening point of 139° C.) was melted and injected into the molten nylon copolymer in the transfer line at a level of 1.5 parts of polypropylene per 98.5 parts nylon copolymer. Fiber was spun at an extrusion rate of 123 grams/spinneret hole/hour as 330 trilobal filaments with a modification ratio of 2.9, cold drawn to 14 denier per filament and cut to 7.5 inch staple. During the fiber spinning process, yarn guide surfaces were carefully monitored and no deposits were noted.

Control A

Polyhexamethylene adipamide of 62 relative viscosity and containing 0.3% titanium dioxide was melted in a screw extruder, then fed through a transfer line to a meter pump, filter pack, and spinneret in a conventional manner. During passage of the polyhexamethylene adipamide through the transfer line, a pelletized polypropylene (molecular weight 6600, melt point of 156° C., viscosity of 320 CP and softening point of 139° C.) was melted and injected into the molten nylon polymer in the transfer line at a level of 1.5 parts of polypropylene per 98.5 parts nylon polymer. Fiber was spun at an extrusion rate of 123 grams/spinneret hole/hour as 330 trilobal filaments with a modification ratio of 2.9, cold drawn to 14 denier per filament and cut to 7.5 inch staple. During the fiber spinning process, white deposits quickly appeared on yarn guide surfaces. These deposits were shown to be polypropylene by proton NMR and solubility analysis using both tetrachloroethylene and formic acid.

Control B

Polyhexamethylene adipamide was melt extruded with 1.5% polypropylene as described in Control A, except that titanium dioxide was omitted. During the fiber spinning process, white deposits consisting of polypropylene quickly appeared on yarn guide surfaces.

Control C

Polyhexamethylene adipamide was melt extruded as described in Control A, except that polypropylene was injected at a level of 0.5%. During the fiber spinning process, white deposits consisting of polypropylene appeared on yarn guide surfaces.

Example 2

A random copolymer of nylon 6,6/nylon 6 (90:10 weight ratio) was prepared by polymerizing hexamethylene diamine and adipic acid in the presence of 10% by weight caprolactam to 62 relative viscosity. Titanium dioxide was added at a level of 0.3% by weight to the copolymer. The nylon 6,6/ nylon 6 copolymer containing 0.3% titanium dioxide was melted in a screw extruder, then fed through a transfer line to a meter pump, filter pack and spinneret in a conventional manner. During passage of the nylon copolymer through the transfer line, a pelletized polypropylene (molecular weight 6600, melt point of 156° C., viscosity of 320 CP and softening point of 139° C.) was melted and injected into a molten nylon copolymer in the transfer line at a level of 3.5 parts of polypropylene per 96.5 parts nylon copolymer. Fiber was spun at an extrusion rate of 122.9 grams/spinneret hole/hour as 332 trilobal filaments with a modification ratio of 2.3, cold drawn to 15 denier per filament and cut to 7.5 inch staple. During the fiber spinning process, yarn guide surfaces were carefully monitored and no deposits were noted.

What is claimed is:

1. In a process of melt-spinning a fiber from nylon 6,6 and polypropylene including the passing of said fiber over a yarn guide wherein deposits of polypropylene are formed on said guide, the improvement comprising:
   substantially eliminating said deposits by mixing 2–10% by weight nylon 6 with 85–97.9% by weight nylon 6,6 and 0.1–5% by weight polypropylene.

2. The process of claim 1 wherein nylon 6 is first mixed with nylon 6,6.

3. The process of claim 2 wherein nylon 6 and nylon 6,6 are mixed as monomers to form a copolymer.

4. The process of claim 2 or 3 wherein 2–4% by weight nylon 6 is mixed with 94–97% by weight nylon 6,6 and 1–2% by weight polypropylene.

5. The process of claim 2 or 3 wherein 0.01–0.5% titanium dioxide is also added into the mix.

* * * * *